United States Patent [19]

Spamer et al.

[11] Patent Number: 4,997,094

[45] Date of Patent: Mar. 5, 1991

[54] COMPOSITE ORGANIZER SHELF

[75] Inventors: William S. Spamer, Roswell; Dennis E. Parham, Social Circle, both of Ga.

[73] Assignee: The Mead Corporation, Dayton, Ohio

[21] Appl. No.: 391,424

[22] Filed: Aug. 9, 1989

[51] Int. Cl.[5] ..... A47F 5/00

[52] U.S. Cl. ..... 211/153; 211/59.2; 211/175

[58] Field of Search ..... 211/59.2, 184, 133, 211/175, 189, 153; 248/220.3

[56] References Cited

U.S. PATENT DOCUMENTS

| | | | |
|---|---|---|---|
| 3,452,959 | 7/1969 | Ishikawa | 248/220.3 X |
| 3,513,786 | 5/1970 | Kellogg | 211/153 X |
| 3,832,957 | 9/1974 | Mendenhall | 211/153 X |
| 4,478,337 | 10/1984 | Flum | 211/153 X |
| 4,690,287 | 9/1987 | Fershko et al. | 211/128 X |
| 4,724,968 | 2/1988 | Wombacher | 211/184 X |
| 4,782,959 | 11/1988 | Kral et al. | 211/59.2 |
| 4,785,943 | 11/1988 | Deffner et al. | 211/59.2 |
| 4,785,945 | 11/1988 | Rowse et al. | 211/59.2 |
| 4,801,025 | 1/1989 | Flum et al. | 211/153 X |

*Primary Examiner*—Robert W. Gibson, Jr.
*Attorney, Agent, or Firm*—Rodgers & Rodgers

[57] ABSTRACT

A composite organizer shelf for supporting and displaying articles includes main and auxiliary support units each of which includes a rectangular panel element having front, rear and opposed side edges, at least one edge of the main support unit being of a complementary configuration to one edge of the auxiliary support unit, and disjointable coupling means for securing the one edge of each of the rectangular planar elements together so as to increase the effective area of the composite shelf. Since disjointable coupling means is used, the auxiliary rectangular planar element may be removed if need be so as to restore the shelf to the size of the main rectangular planar element.

16 Claims, 2 Drawing Sheets

COMPOSITE ORGANIZER SHELF

TECHNICAL FIELD

This invention pertains to a shelving structure for use as a gravity feed device or in some instances as a product organizing device, the structure being arranged for mounting on suitable supporting means, either as a single unit or as a stacked arrangement.

BACKGROUND ART

U.S. Pat. No. 4,690,287 issued Sep. 1, 1987 and owned by the assignee of this invention discloses a display device such as is used in refrigerators commonly used in supermarkets and the like and includes a main central portion together with side portions which are frangibly secured to the main central portion so that removal of one or more frangible side portions effectively reduces the area and overall capacity of the display device.

U.S. Pat. No. 4,724,968 issued Feb. 16, 1988 discloses a display device wherein a composite structure is formed of interconnected elements.

U.S. Pat. No. 4,785,945 issued Nov. 22, 1988 discloses combinations of laterally interlocked modules.

U.S. Pat. No. 4,801,025 issued Jan. 31, 1989 discloses a shelf organizer unit having frangible side and rear portions.

A principal objection to shelving having frangible portions is that such devices cannot be restored to their original size once the frangible portions are broken away. Also once a frangible element is ruptured, a jagged edge is exposed.

SUMMARY OF THIS INVENTION

A composite organizer shelf for supporting and displaying articles and arranged according to one form of this invention comprises a main support unit including a main rectangular panel element having front, rear and opposed side edges, at least one auxiliary support unit including an auxiliary rectangular planar element having front, rear and opposed side edges, at least one edge of said main rectangular planar element being of a configuration which is complementary to one edge of said auxiliary rectangular planar element, and disjointable coupling means for securing said one edge of said main rectangular element to said edge of said auxiliary rectangular planar element.

In some applications of the invention, a first auxiliary rectangular planar element may be disjointably coupled with a main rectangular planar element and a second auxiliary rectangular planar element may be disjointably coupled with said first auxiliary planar element.

BEST MODE OF CARRYING OUT THE INVENTION

Figure 1:
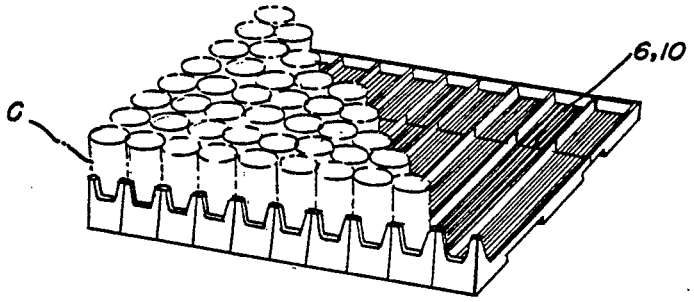
FIG. 1 is a perspective view of an organizer shelf which may be conveniently mounted on a support such as a conventional shelf.
Figure 2:
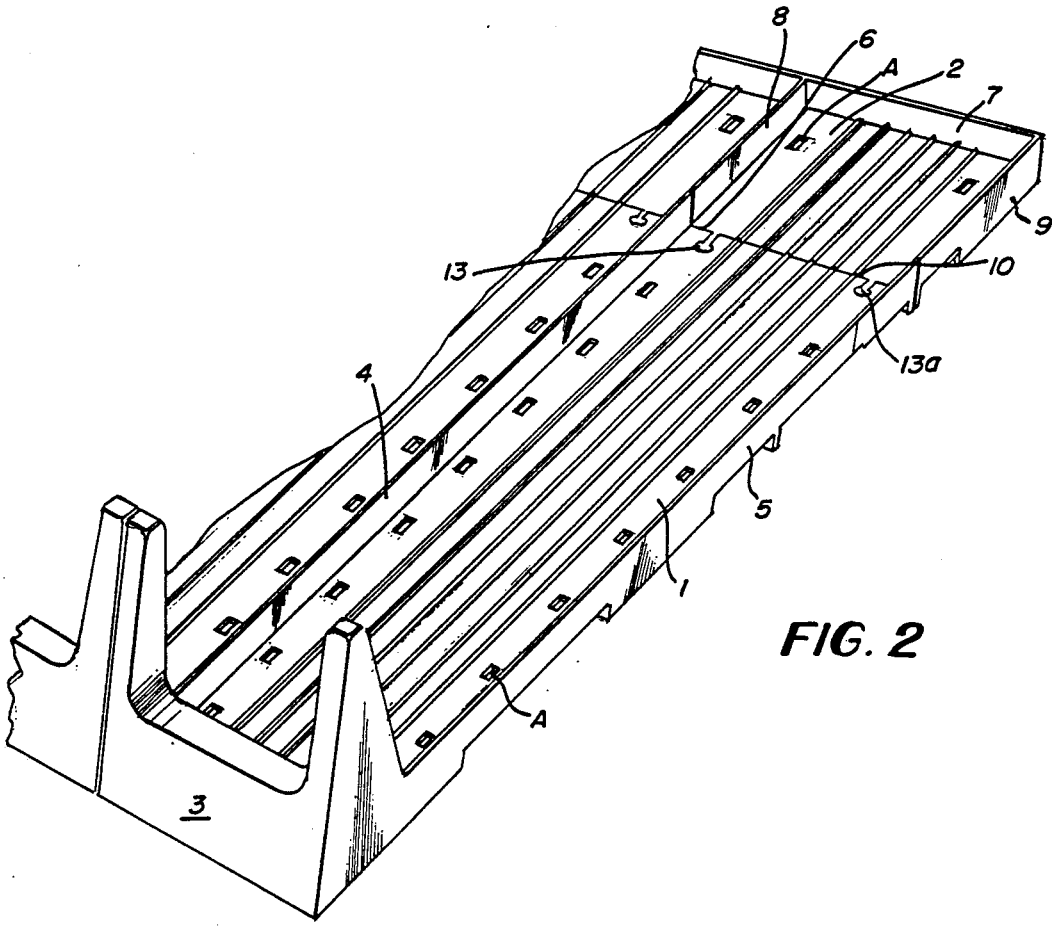
FIG. 2 is an enlarged perspective view of a portion of a composite shelf formed according to this invention.

In FIG. 1 a composite shelf formed according to this invention is shown and displays cans or other articles C. In FIG. 2 a fragment of a shelf unit is shown which includes a main support unit designated by the numeral 1 and an auxiliary support unit 2 which is disjointably connected along its front edge to the rear edge of main support unit 1 in accordance with one aspect of this invention. Main support unit 1 includes a front wall 3 together with divider wall 4 and side wall 5. As is apparent, main support unit 1 is provided with front and side edges from which the walls 3, 4 and 5 are upstanding. The rear edge of main support unit 1 is designated by the numeral 6.

The auxiliary support unit shown in FIG. 2 and designated by the numeral 2 includes rear wall 7, divider wall 8 and side wall 9. These walls as is obvious from FIG. 2 are upstanding from auxiliary unit 2. The front edge of auxiliary unit 2 is designated by the numeral 10.

Figure 3:
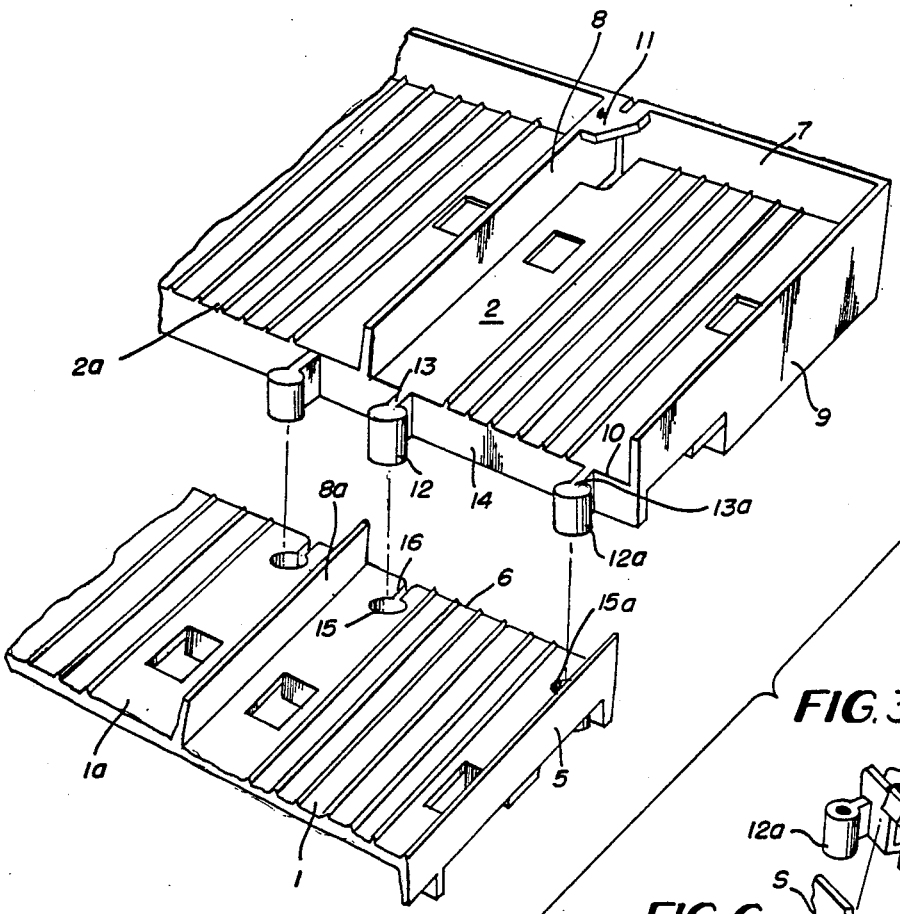
FIG. 3 is an enlarged perspective view of fragments of a main shelf and of an auxiliary shelf which may be disjoin coupled together according to this invention.

As shown in FIG. 3, upstanding wall 8 separates auxiliary support unit 2 from auxiliary support unit **2*a* and these panels may be held together by frangible means generally designated by the numeral 11 as more fully disclosed in U.S. Pat. No. 4,690,287. In like fashion, upstanding wall 8*a* separates the fragment of main support unit 1 from a fragment of main support unit 1*a***.

For disjointably connecting main support unit 1 with auxiliary support unit 2, a post 12 is integrally formed with standoff stud 13 which in turn is integrally formed with reinforcing cross strut 14. Socket 15 and its associated channel 16 are formed in main support unit 1. The connection between units 1 and 2 is effected by relative movement in a direction substantially perpendicular to the planes thereof when post 12 is inserted into socket 15 with standoff stud 13 disposed in channel 16. Similarly post **12*a* is inserted into socket 15*a* when the parts 1 and 2 are interconnected. Portions of the socket 15*a* and of the associated channel are not observable in FIG. 3. The main rectangular planar element 1 is shown interconnected with the auxiliary rectangular planar element 2 in FIG. 2**.

For some applications of the invention some or all of the posts may be attached to the main support unit and some or all of the sockets may be formed in the auxiliary support unit.

Figure 6:
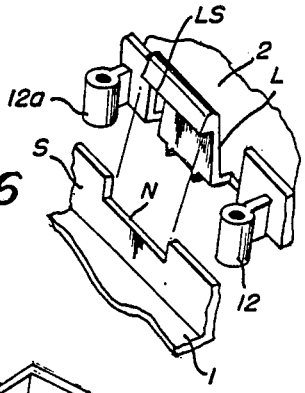
FIG. 6 is an exploded fragmentary perspective upside down view of a latch mechanism formed according to one aspect of this invention and which is shown in cross section in FIG. 5.
Figure 5:
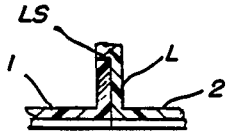
FIG. 5 is a detail cross sectional view taken along the line designated 5—5 in FIG. 4.
Figure 4:
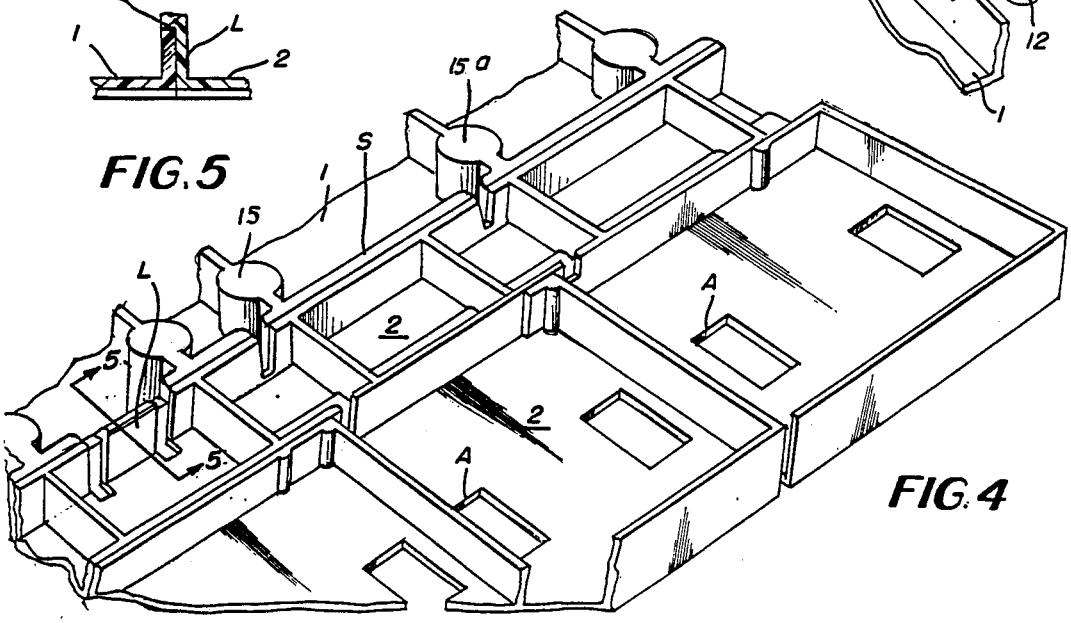
FIG. 4 is a perspective view from below of the lower surface of a composite shelf formed according to this invention.

When the parts assembled as shown in FIG. 2, a secondary securing means may be used to supplement the coupling of the posts, thereby to provide additional security in holding the parts together. One example of such means may be the latch L shown in FIGS. 4, 5 and 6. The latching surface LS best shown in FIGS. 5 and 6 overlies the notch N formed in a transverse reinforcing strut S formed integrally with the rear edge 6 of main rectangular planar element 1. Other securing means may be substituted.

Apertures A are formed in various locations to facilitate air circulation and to reduce weight.

As is apparent, the structure formed according to this invention may be used in a flat condition on a level supporting structure or may be operated as a gravity feed device if desired. The arrangement shown in the drawings and as described herein contemplates a main rectangular planar element such as 1 to the rear edge 6 of which the front edge 10 of auxiliary rectangular planar element 2 is disjointably secured. Obviously auxiliary planar elements may be disjointably secured to the side edges of main rectangular support element such as 1. Also a second auxiliary planar element may be disjointably secured to the rear edge of auxiliary planar element 2 in which case rear wall 7 would probably be omitted from auxiliary planar element 2. If provision is made for detachment of the front wall 3 from main rectangular planar element 1, an auxiliary unit having a front wall formed thereon and configured differently from the front wall 3 shown in FIG. 2 may be provided in order to accommodate different sizes and shapes of displayed articles.

By disjointably connecting or disconnecting main and auxiliary side panels, the number of channels could be varied.

The structure of this invention may be formed by a conventional plastic thermoforming process such as injection molding or a vacuum forming process.

We claim:

1. A composite shelf for supporting and displaying articles and comprising a main support unit including a main rectangular planar element having front, rear and opposed side edges, an auxiliary support unit including an auxiliary rectangular planar element having front, rear and opposed side edges one of which is of a configuration which is complementary to one edge of said main rectangular planar element, disjointable coupling means for securing said one edge of said main rectangular planar element to said one edge of said auxiliary rectangular planar element in response to relative movement of said main and said auxiliary planar elements in a direction substantially perpendicular to the planes thereof, and secondary securing means for releasably opposing uncoupling relative movement of said main and of said auxiliary planar elements.

2. A composite shelf according to claim 1 wherein the front edge of said auxiliary rectangular planar element is disjointably coupled with the rear edge of said main rectangular planar element.

3. A composite shelf according to claim 1 wherein a side edge of said auxiliary rectangular planar element is disjointably coupled with a side edge of said main rectangular planar element.

4. A composite shelf according to claim 1 wherein said secondary securing means includes a latch element yieldably mounted on one of said support units and arranged for latching engagement and disengagement with a part of the other of said support units.

5. A composite shelf according to claim 4 wherein said latch element is mounted on said auxiliary support unit and arranged to cooperate with a part of said main support unit.

6. A composite shelf according to claim 1 wherein said disjointable coupling means comprises a socket formed in one of said rectangular planar elements near said one edge thereof, and a passageway between said socket and said one edge, a post, and means connecting said post to said one edge of the other of said rectangular planar elements, said connecting means being of smaller transverse dimension than the transverse dimension of said post, said post being disposed in said socket when said support units are coupled together.

7. A composite shelf according to claim 1 wherein said disjointable coupling means comprises a socket formed in one of said rectangular planar elements near said one edge thereof and a channel of smaller transverse dimension than the transverse dimension of said socket and forming a passageway between said socket and said one edge, a standoff stud projecting from said one edge of the other of said rectangular planar elements, and a post secured to said standoff stud, said standoff stud being of smaller transverse dimension than the transverse dimension of said post and said standoff stud being disposed in said channel and said post being disposed in said socket when said support units are coupled together.

8. A composite shelf according to claim 7 wherein said socket and said channel are formed in said main rectangular planar element and said stud and said post project from said auxiliary rectangular planar element.

9. A composite shelf according to claim 8 wherein said socket and said channel project downwardly from the top surface of said main rectangular planar element.

10. A composite shelf according to claim 8 wherein the upper surfaces of said stud and of said post are flush with the upper surface of said auxiliary rectangular planar element.

11. A composite shelf according to claim 6 wherein said socket and said post are of circular cross section.

12. A composite shelf according to claim 6 wherein said socket and said post are of cylindrical configuration.

13. A composite shelf according to claim 12 wherein the axes of said socket and of said post are normal to said main and said auxiliary rectangular planar elements respectively.

14. A composite shelf according to claim 1 wherein a second edge of said auxiliary rectangular planar element is of a complementary configuration to an edge of a second rectangular planar element.

15. A composite shelf according to claim 14 wherein said second edge of said auxiliary rectangular planar element is the rear edge of said auxiliary rectangular planar element.

16. A composite shelf for supporting and displaying articles and comprising a main support unit including a main rectangular planar element having front, rear and opposed side edges, an auxiliary support unit including an auxiliary rectangular planar element having front, rear and opposed side edges one of which is of a configuration which is complementary to one edge of said main rectangular planar element, disjointable coupling means for securing said one edge of said main rectangular planar element to said one edge of said auxiliary rectangular planar element, and secondary securing means supplementing the coupling of said main and auxiliary planar elements and including a latch element mounted on one of said support units and arranged for latching engagement with a part of the other of said support units.

* * * * *